United States Patent [19]

Koizumi et al.

[11] Patent Number: 4,967,917

[45] Date of Patent: Nov. 6, 1990

[54] JIB DERRICKING GEAR FOR A CRANE

[75] Inventors: Yukio Koizumi, Akashi; Shunsuke Yokoyama, Kakogawa; Takahiro Kobayashi, Himeji, all of Japan

[73] Assignee: Kabushiki Kaisha Kobe Seiko Sho, Kobe, Japan

[21] Appl. No.: 372,454

[22] Filed: Jun. 28, 1989

[30] Foreign Application Priority Data

| | | | |
|---|---|---|---|
| Aug. 3, 1988 | [JP] | Japan | 63-102917[U] |
| Sep. 30, 1988 | [JP] | Japan | 63-129088[U] |
| Jan. 26, 1989 | [JP] | Japan | 1-8882[U] |

[51] Int. Cl.[5] ..... B66C 23/42

[52] U.S. Cl. ..... 212/188; 212/168; 212/250; 212/261; 212/262; 212/266

[58] Field of Search ..... 212/168, 187, 188, 238, 212/239, 261, 262, 266, 267, 150

[56] References Cited

U.S. PATENT DOCUMENTS

| | | | |
|---|---|---|---|
| 3,809,250 | 5/1974 | Pilch | 212/261 |

FOREIGN PATENT DOCUMENTS

| | | | |
|---|---|---|---|
| 66567 | 12/1982 | European Pat. Off. | 212/238 |
| 1900752 | 8/1970 | Fed. Rep. of Germany | 212/239 |
| 2594427 | 8/1987 | France | 212/187 |
| 962188 | 9/1982 | U.S.S.R. | 212/261 |
| 11192 | of 1889 | United Kingdom | 212/203 |
| 1378740 | 12/1974 | United Kingdom | 212/239 |

*Primary Examiner*—Sherman Basinger
*Assistant Examiner*—Thomas J. Brahan
*Attorney, Agent, or Firm*—Oblon, Spivak, McClelland, Maier & Neustadt

[57] ABSTRACT

A jib derricking gear for a jib crane having a boom and a jib for hoisting work extended from the boom head of the boom comprises a pair of jib derricking cylinder actuators. Load on the jib is distributed to the pair of jib derricking cylinder actuators, so that each jib derricking cylinder actuator may be such as having a cylinder having a comparatively small diameter. The jib derricking cylinder actuators are combined with the jib so that the jib derricking cylinder actuators function as compression members. The thrust of the jib derricking cylinder actuator is doubled by a tackle. The jib derricking cylinder actuators and the associated jib supporting members are disposed so that the jib derricking cylinder actuators and the associated jib supporting members will not interfere with a hoist rope for hoisting work.

10 Claims, 11 Drawing Sheets

JIB DERRICKING GEAR FOR A CRANE

BACKGROUND OF THE INVENTION AND RELATED ART STATEMENT

The present invention relates to a jib derricking gear for derricking a jib hinged to the extremity of a crane boom.

FIGS. 17 to 20 illustrates a known jib derricking gear operated by an operator seated in an operator cab in order to derrick a jib.

Shown in FIGS. 17 to 20 are a crane boom 1, a jib 2 hinged to the extremity (hereinafter referred to as "boom head") 11, and a pair of suspension rods 3 extended on the opposite sides of the jib 2 between the boom head 11 and the extremity of the jib 2 to suspend the jib 2.

The suspension rods 3 each have one end joined to the boom head 11 and the other end connected through a jib derricking cylinder actuator 4 to the extremity of the jib 2. The jib derricking cylinder actuator 4 is operated in order to derrick the jib 2.

The jib derricking cylinder actuator 4 is disposed on the upper surface of the jib 2, namely, the upper surface of the jib 2 when extended horizontally (In the following description, all directions are denoted on the same basis), on the extensions of the suspension rods 3, as viewed in a side elevation, and parallel to the center axis of the jib 2, as viewed in a plan view. The free end of the rod of the jib derricking cylinder actuator 4 is joined to the extremities of the suspension rods 3 by an equalizer 5, and the cylinder of the same is joined to the jib 2.

The jib 2 has an outer jib 21 and an inner jib 22 slidably received in the outer jib 21. The length of the jib 2 can be adjusted by axially moving the inner jib 22 relative to the outer jib 21. The cylinder of the jib derricking cylinder actuator 4 is joined at one end thereof to the upper surface of the extremity of the outer jib 21.

In this known jib derricking gear, a. load on the jib derricking cylinder actuator 4 is comparatively large because the jib 2 is derricked only by the single jib derricking cylinder actuator 4, and b. the smaller pressure receiving surface of the piston on the side of the rod is the loading side when the jib 2 is supported, because the jib derricking cylinder actuator 4 acts as a tension member similarly to the suspension rods 3.

Accordingly, the jib derricking cylinder actuator 4 must have a cylinder with a large diameter, and hence the jib 2 protrudes laterally from the side of the boom 1 by a large amount of protrusion when the jib 2 is stored longitudinally alongside the boom 1 when the jib derricking cylinder actuator 4 has a large cylinder, which makes the operation of the crane with the jib stored alongside the boom difficult particularly in a narrow place and obstructs the front visual field of the operator in moving the crane.

SUMMARY OF THE INVENTION

Accordingly, it is an object of the present invention to provide a jib derricking gear which eliminates the foregoing disadvantages of the known jib derricking gear.

Other objects and advantages of the present invention will become apparent from the following description.

In a first aspect of the present invention, a jib derricking gear for a crane comprises a pair of extendible suspension assemblies extended alongside the opposite sides of a jib, respectively, each having one end joined to the boom head of a boom and the other end joined to the jib, and each comprising a suspension rod and a jib derricking cylinder actuator joined to one end of the suspension rod.

In this jib derricking gear, load on the jib is distributed to the two jib derricking cylinder actuators and hence the jib derricking cylinder actuators may be such as having a cylinder having a comparatively small diameter.

In a second aspect of the present invention, a jib is joined to the front end of a boom, jib derricking cylinder actuators are disposed near the front end of the jib so as to be extendible in the direction of the length of the jib with the movable actuating members thereof on the side of the front end of the jib, the rear ends of suspension rods are joined to the extremity of a boom, and the front ends of the suspension rods are joined to the movable actuating members of the jib derricking cylinder actuators, respectively.

In a third aspect of the present invention, a jib is joined to the front end of a boom, a sliding frame is put on a jib joined to the front end of the jib so as to be slidable along the jib, jib derricking cylinder actuators are disposed near the front end of the jib so as to be extendible in the direction of length of the jib with the movable actuating members thereof on the side of the front end of the jib, the front ends of the movable actuating members of the jib derricking cylinder actuators are joined to the sliding frame, the front ends of suspension rods are joined to the sliding frame, and the rear ends of the suspension rods are joined to the extremity of the boom.

In the jib derricking gears in the second and third aspect of the present invention, a tensile force acting on the suspension rods acts as a compressive force on the jib derricking cylinder actuators; that is, the jib derricking cylinder actuators function as compression members and the head side having a greater pressure receiving area of pistons is the loaded side. Accordingly, the jib derricking cylinder actuators may be such as having cylinders having a comparatively small diameter.

In a fourth aspect of the present invention, a jib is joined to the front end of a boom, a jib derricking cylinder actuator is disposed near the front end of the jib so as to be extendible in the direction of length of the jib, an equalizer sheave is supported on the front end of the boom so as to be swingable in directions of swing motion of the jib, and a jib guy rope having one end fixed to the jib derricking cylinder actuator and the other end fixed to the front end of the jib is extended around the equalizer sheave.

In this jib derricking gear, the thrust of the jib derricking cylinder actuator is doubled by the equalizer sheave, and hence the jib derricking cylinder actuator may be such as having a cylinder having a comparatively small diameter.

Thus, the present invention reduces the amount of lateral protrusion of the jib from the boom when the jib is stored alongside the boom.

DETAILED DESCRIPTION OF THE PREFERRED EMBODIMENTS

First Embodiment (FIGS. 1 to 6)

Figure 1:
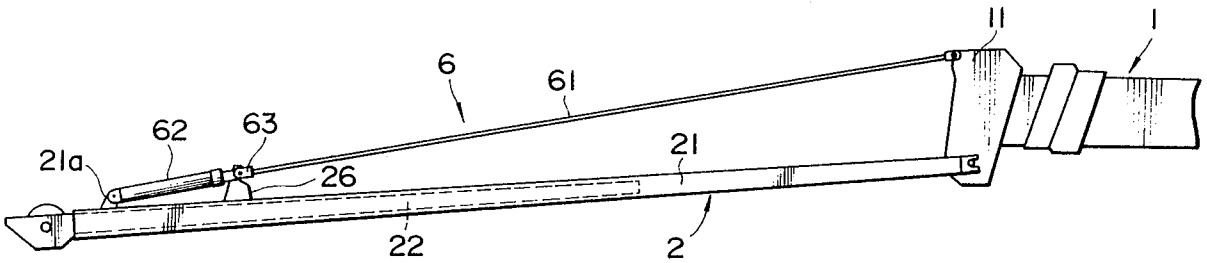
FIG. 1 is a side elevation of a jib, in a stretched position, provided with a jib derricking gear in a first embodiment according to the present invention.
Figure 2:
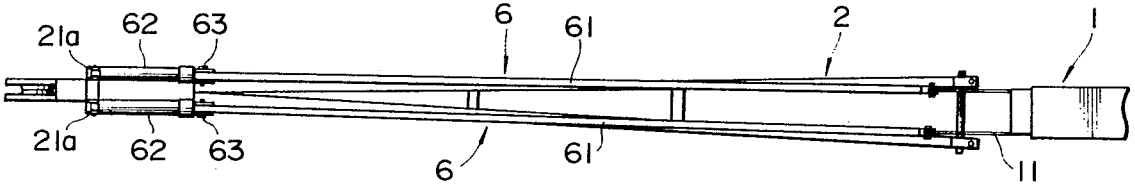
FIG. 2 is a plan view of the jib of FIG. 1.
Figure 3:
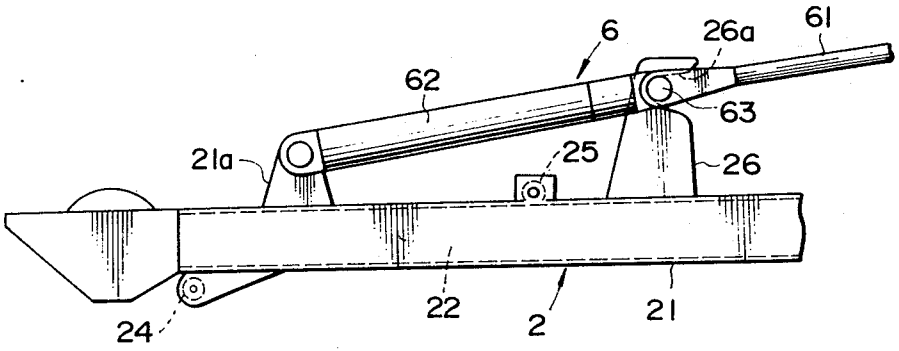
FIG. 3 is an enlarged side elevation of a portion of FIG. 1.
Figure 4:
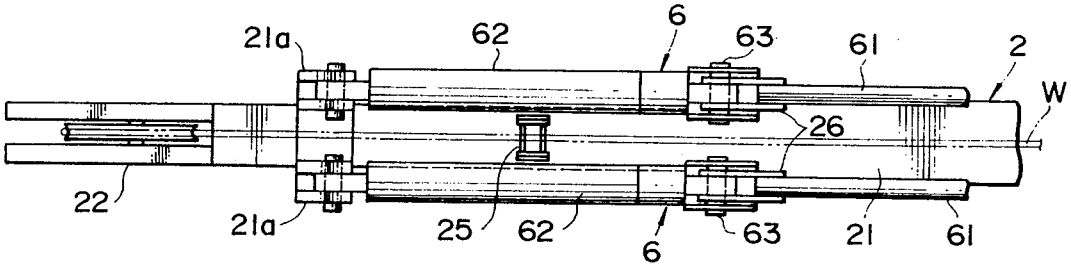
FIG. 4 is an enlarged plan view of a portion of FIG. 2.
Figure 5:
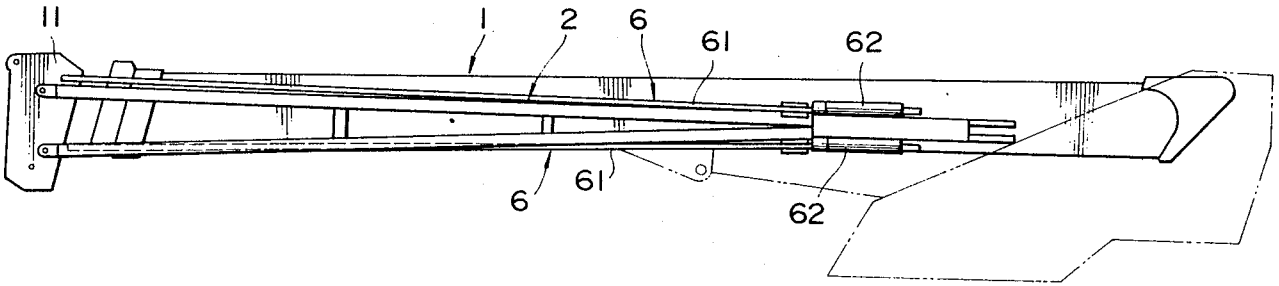
FIG. 5 is a side elevation of the jib of FIG. 1 in a stored position.
Figure 6:
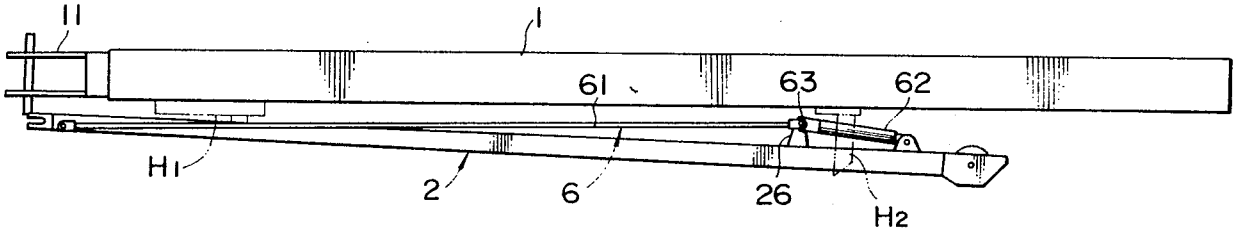
FIG. 6 is a plan view of the jib of FIG. 1 in a stored position.
Figure 7:
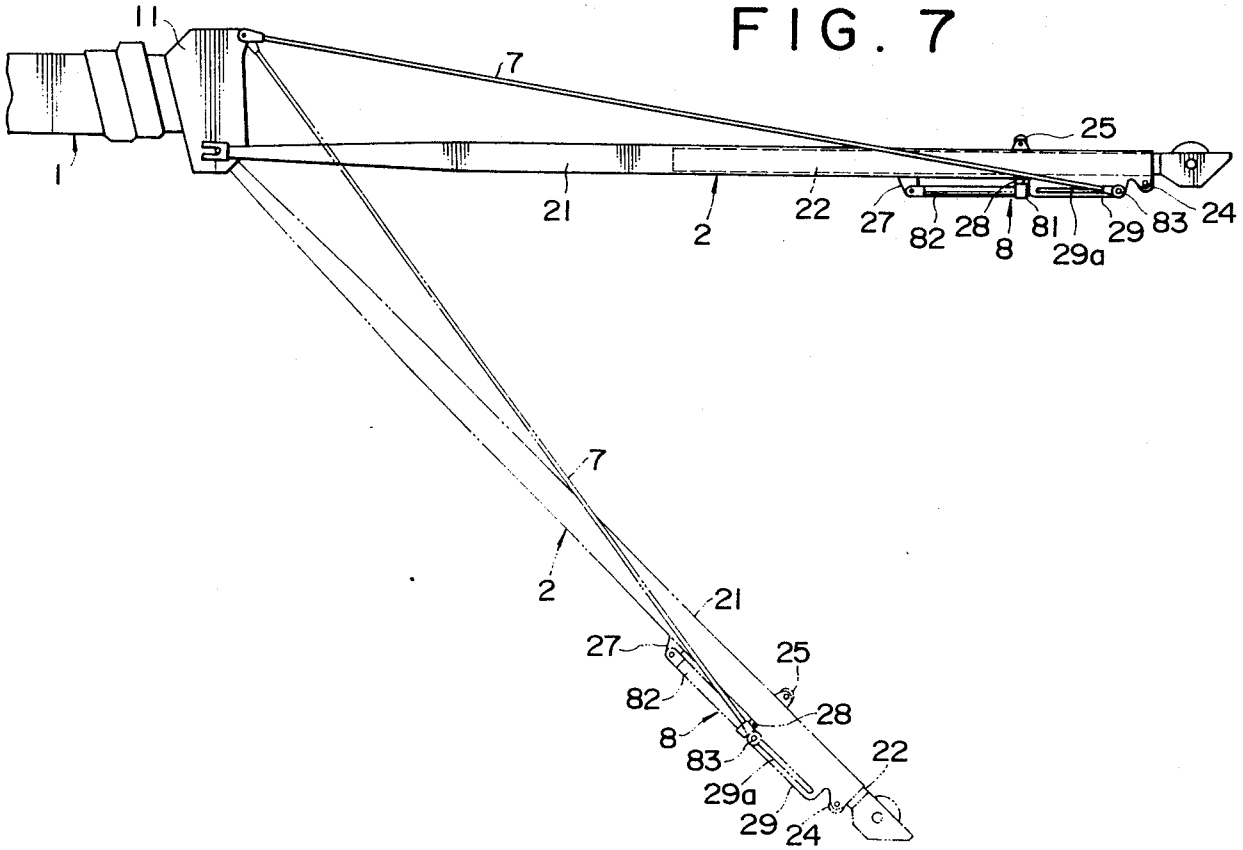
FIG. 7 is a side elevation of a jib, in a stretched position, provided with a jib derricking gear in a second embodiment according to the present invention.
Figure 8:
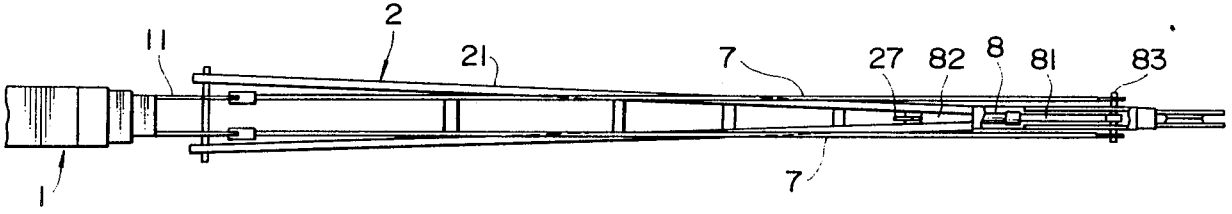
FIG. 8 is a plan view of the jib of FIG. 7.
Figure 9:
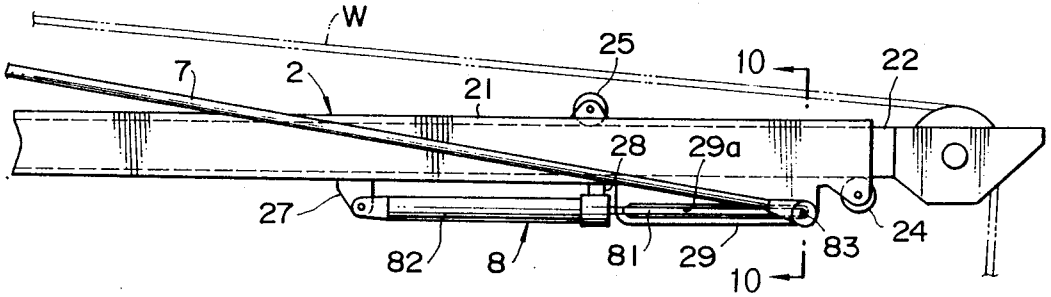
FIG. 9 is an enlarged side elevation of a portion of the jib of FIG. 7.
Figure 10:
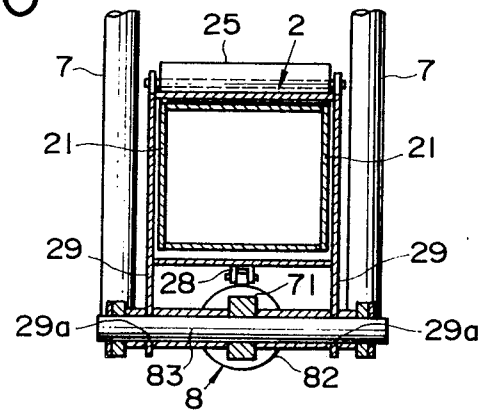
FIG. 10 is an enlarged sectional view taken on line X—X in FIG. 9.

In FIGS. 1 to 4, a jib is in a stretched position and, in FIGS. 5 and 6, the jib is in a stored position.

A pair of extendible suspension assemblies 6 are extended between a boom head 11 and a jib 2 to suspend the jib 2 for derricking motion.

Each extendible suspension assembly 6 comprises a suspension rod 61 and a jib derricking cylinder actuator 62 axially joined to the suspension rod 61. The jib 2 is a telescopic jib consisting of an outer jib member 21 and an inner jib member 22.

The front ends of the suspension rods 61 are joined pivotally to the extremities of the piston rods of the jib derricking cylinder actuators 62 with laterally horizontal connecting pins 63, respectively, the base ends of the jib derricking cylinder actuators 62 are joined pivotally to brackets 21*a* provided on the right and left sides of the upper surface of the front end of the outer jib 21, respectively, and the rear ends of the suspension rods 61 are joined pivotally to the right and left walls of the boom head 11 of a boom 1 with laterally horizontal connecting pins, respectively.

The suspension rod assemblies 6 are extended between the boom head 11 and the jib 2 alongside the opposite sides of the jib 2, respectively. When the piston rods of the jib derricking cylinder actuators 62 are stretched out or retracted, the respective lengths of the suspension rod assemblies 6 are increased or decreased to turn the jib 2 on the connecting pin relative to the boom head 11.

The jib derricking cylinder actuators 62 are driven by a known hydraulic circuit, not shown, so that the piston rods thereof are moved simultaneously in the same direction by the same distance.

Since a load on the jib 2 is distributed to the jib derricking cylinder actuators 62, the diameter of the cylinder of each jib derricking cylinder actuator 62 is smaller than that of the cylinder of the single jib derricking cylinder actuator 4 of the conventional jib derricking gear and hence the jib derricking cylinder actuators 62 can be received in a reduced space between the jib 2 and the boom 1 when the jib 2 is stored alongside the boom 1. Therefore, the jib 2 protrudes laterally from the side wall of the boom 1 by a reduced amount of protrusion when stored alongside the boom 1.

The use of the two suspension rod assemblies 6 for suspending the jib 2 has the following advantages.

Figure 19:
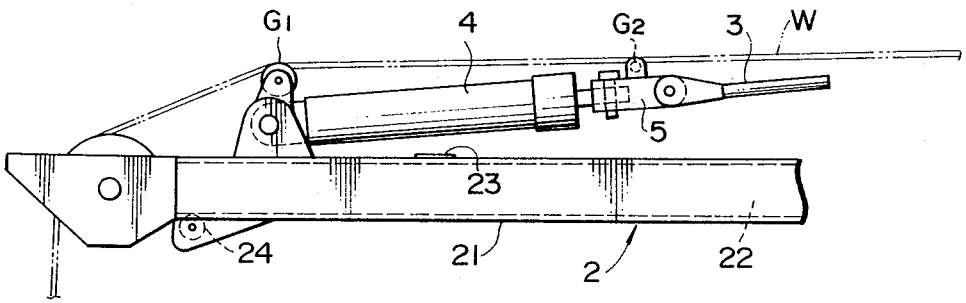
FIG. 19 PRIOR ART
FIG. 19 is an enlarged view of a portion of FIG. 17.
Figure 20:
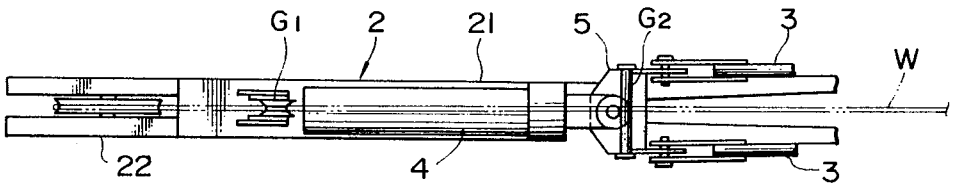
FIG. 20 PRIOR ART
FIG. 20 is an enlarged view of a portion of FIG. 18.

(I) In the jib provided with the conventional jib derricking gear as shown in FIGS. 17 to 20, a hoist rope W is extended between the boom head 11 and a point sheave attached to the extremity of the jib 2 in a vertical plane including the center axis of the jib 2, and rope guide members, namely, guide rollers or guide sheaves, $G_1$ and $G_2$ are provided near the opposite ends of the jib derricking cylinder actuators 4 as shown in FIGS. 19 and 20 to guide the hoist rope W so that the jib derricking cylinder actuator 4 will not interfere with the hoist rope W. These guide members $G_1$ and $G_2$ accelerate the abrasion of the hoist rope W.

On the other hand, in the jib provided with the jib derricking gear of the present invention, the suspension rod assemblies 6 respectively comprising, in combination, the suspension rods 61 and the jib derricking cylinder actuators 62 are extended along the opposite side walls of the jib 2, respectively, and hence a hoist rope W (FIG. 4) is extended between the boom head 11 and a point sheave attached to the extremity of the jib 2 through a vacant space above the center axis of the jib 2 without requiring any guide members, such as the guide members $G_1$ and $G_2$, which accelerate the abrasion of the hoist rope W.

(II) An ordinary two-section telescopic jib is provided with a lower guide roller at the front end of the outer jib 21 so as to be in contact with the lower surface of the inner jib 22, and an upper guide roller on the outer jib 21 behind the lower guide roller 24 so as to be in contact with the upper surface of the inner jib 22 to enable the inner jib 22 to slide smoothly relative to the outer jib 21.

However, the jib derricking cylinder actuator 4 of the conventional jib derricking gear is placed at a position corresponding to the upper guide roller and interferes with the upper guide roller. Accordingly, the jib provided with the conventional jib derricking gear is inevitably provided with a flat pad 23 as shown in FIG. 19 instead of the upper guide roller. In FIG. 19, indicated at 24 is a lower guide roller. Consequently, the inner jib 22 must be moved against an increased resistance and hence the inner jib 22 is unable to be moved smoothly relative to the outer jib 21.

On the other hand, the jib derricking gear of the present invention allows a large guide roller 25 to be placed on the outer jib 21 so as to be in contact with the upper surface of the inner jib as shown in FIGS. 3 and 4, so that the inner jib 22 can be smoothly moved relative to the outer jib 21. Furthermore, although the jib derricking gear of the present invention employs the two jib derricking cylinder actuators 62, the weight of the suspension mechanism including the jib derricking gear of the present invention is substantially the same as that of the suspension mechanism including the conventional jib derricking gear, because the equalizer 5 and the guide members $G_1$ and $G_2$ are omitted.

When the jib 2 is stored, the suspension rods 61 of the suspension rod assemblies 6 are disconnected from the boom head 11 and are stored alongside the boom 1 with the jib derricking cylinder actuators 62 held on a pair of holding brackets 26 attached on the upper surface of the outer jib 21 near the front end of the same. When the piston rods of the jib derricking cylinder actuators 62 are fully retracted, the pins 63 pivotally joining the extremities of the piston rods of the jib derricking cylinder actuators 62 to the front ends of the corresponding suspension rods 61 automatically engage recesses **26*a* formed in the holding brackets 26, respectively, which facilitates the jib storing operation. When the jib 2 is stored alongside the boom 1, the suspension assemblies 6 are stored with the jib derricking cylinder actuators 62 placed between the boom 1 and the jib 2 and with the suspension rods 61 extended alongside the jib 2 as shown in FIGS. 5 and 6. In FIG. 6, indicated at $H_1$ and $H_2$ are known jib holding devices for holding the jib 2** at a stored position.

Incidentally, the jib derricking cylinder actuators 62 may be connected respectively to the rear ends of the suspension rods 61. Furthermore, the suspension rods 61 each may be a two-section suspension rods and the jib derricking cylinder actuator 62 may be provided between the two sections of the suspension rod. However, when the jib derricking cylinder actuators 62 are joined to the front ends of the suspension rods 61, the jib derricking cylinder actuators 62 can be disposed near the jib 2, which facilitates storing the jib derricking cylinder actuators 62 alongside the jib 2.

Second Embodiment (FIGS. 7 to 10)

A jib derricking gear in the second embodiment has a jib derricking cylinder actuator 8 provided on the lower surface of the front end of a jib 2, more specifically, the outer jib 21 of the jib 2 with the piston rod 81 thereof near the front end of the jib 2 and with the cylinder 82 thereof fixed to a bracket 27 fixed to the lower surface of the outer jib 21. In this embodiment, the piston rod 81 of the jib derricking cylinder actuator 8 is a movable actuating member, and the cylinder 82 of the same is a fixed member. Portions of the side walls of the outer jib 21 beyond the cylinder 82 of the jib derricking cylinder actuator 8 are extended downward to form guide portions 29 and longitudinal slots **29*a* are formed in the guide portions 29**, respectively.

The extremity of the piston rod 81, i.e., the movable actuating member, of the jib derricking cylinder actuator 8 is joined to the front ends of the suspension rods 7 with a connecting pin 83 received in the slots **29*a* for movement along the slots 29*a***.

A tensile force acting on the suspension rods 7 acts as a compressive force on the jib derricking cylinder actuator 8. When the piston rod 81 is extended, the jib 2 is turned relative to the boom 1 toward a raised position shown by solid lines in FIG. 7. When the piston rod 81 is retracted, the jib 2 is turned relative to the boom 1 toward a tilted position indicated by imaginary lines in FIG. 7. Since the jib derricking cylinder actuator 8 functions as a compression member, the loaded side of the jib derricking cylinder actuator 8 is on the side of the boom head 11, on which side the pressure receiving area of the piston is greater than that of the other side. Accordingly, the jib derricking cylinder actuator 8 may be such as having a cylinder having a diameter smaller than that of the jib derricking cylinder actuator 4 of the conventional jib derricking gear and having a weight smaller than that of the jib derricking cylinder actuator 4.

Incidentally, a bending force as well as the compressive force acts on the piston rod 81 of the jib derricking cylinder actuator 8. This bending force acts through the connecting pin 83 engaging the slots **29*a* on and is born by the guide portions 29, hence by the jib 2. Accordingly, a reduced load acts on the jib derricking cylinder actuator 8**.

Since the jib derricking cylinder actuator 8 is mounted on the lower surface of the jib 2, a hoist rope W can be extended over the jib 2 without the interference of the jib derricking cylinder actuator 8. Consequently, the jib derricking gear, similarly to that in the first embodiment, eliminates the guide members $G_1$ and $G_2$ (FIGS. 19 and 20), which are necessary in the conventional jib derricking gear, and eliminates problems resulting from the abrasive action of the guide members $G_1$ and $G_2$ on the hoist rope W.

Furthermore, a large guide roller 25 can be provided on the upper surface of the jib 2 to guide the inner jib 22 of the jib 2.

Figure 11:
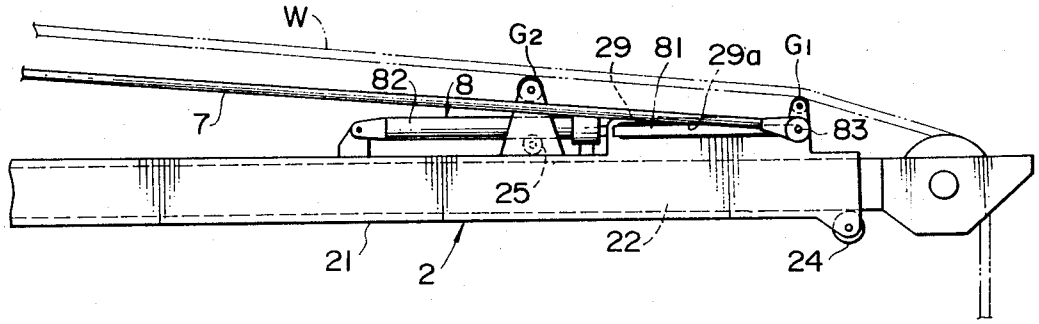
FIG. 11 is an enlarged fragmentary side elevation, similar to FIG. 9, of a jib provided with a jib derricking gear in a third embodiment according to the present invention.

Third Embodiment (FIG. 11)

Basically, a jib derricking gear in a third embodiment according to the present invention is the same in construction, function and effects as the jib derricking gear in the second embodiment, except that the jib derricking gear in the third embodiment includes a jib derricking cylinder actuator 8 provided on the upper surface of a jib 2. The jib derricking gear in the third embodiment needs, similarly to the conventional jib derricking gear, guide members $G_1$ and $G_2$ for guiding a hoist rope W to obviate the interference of the jib derricking cylinder actuator 8 with the hoist rope W. Guide members may be fitted in the slots **29*a* of guide portions 29 in addition to the connecting pin 83 pivotally connecting the piston rod of the jib derricking cylinder actuator 8 to the suspension rods 7 and engaging the slots 29*a* of the guide portions 29**.

Figure 12:
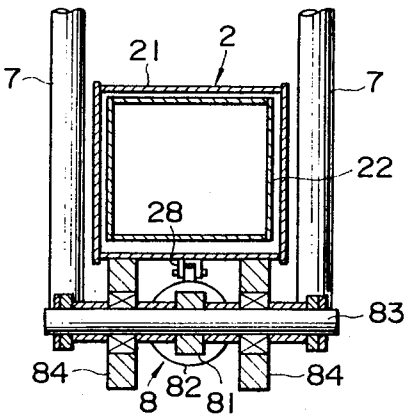
FIG. 12 is a sectional view, similar to FIG. 10, of assistance in explaining a jib derricking gear in a fourth embodiment according to the present invention.

Fourth Embodiment (FIG. 12)

A jib derricking gear in a fourth embodiment according to the present invention is a modification of the jib derricking gear in the second embodiment shown in FIGS. 7 to 10.

In the jib derricking gear in the fourth embodiment, guide rollers 84 are mounted on a connecting pin 83 pivotally connecting suspension rods 7 to the extremity of the piston rod 81 of a jib derricking cylinder actuator 8 so as to roll along the lower surface of a jib 2. A bending force acting on the piston rod 81 of the jib derricking cylinder actuator 8 is transmitted through the guide rollers 84 to the jib 2, so that a reduced load acts on the jib derricking cylinder actuator 8. When the bending force is not very large, the jib derricking gear need not necessarily be provided with such movable guide means, namely, the guide rollers 84.

Figure 13:
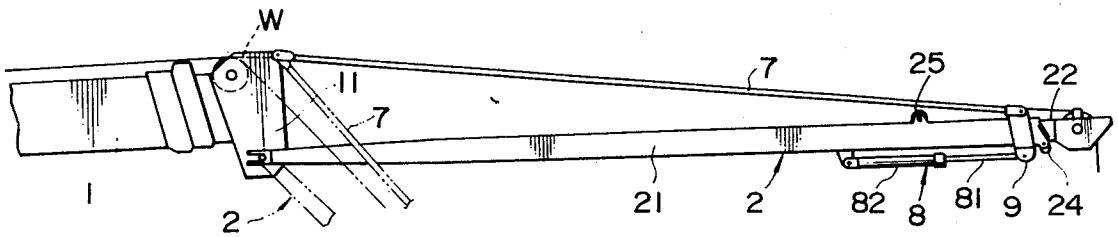
FIG. 13 is a side elevation of a jib, in a stretched position, provided with a jib derricking gear in a fifth embodiment according to the present invention.
Figure 14:
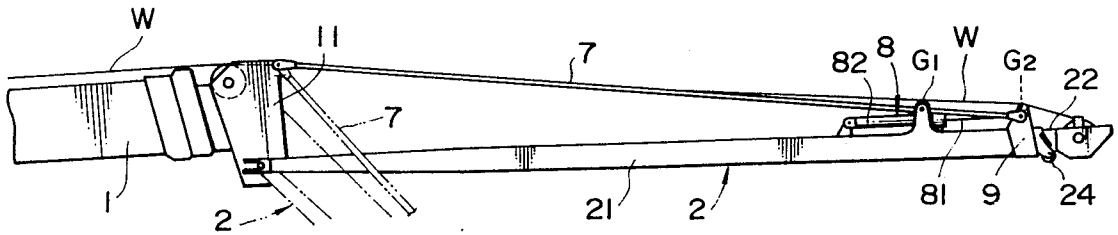
FIG. 14 is a side elevation of a jib, in a stretched position, provided with a jib derricking gear in a sixth embodiment according to the present invention.

Fifth and Sixth Embodiments (FIGS. 13 and 14)

Jib derricking gears in the fifth and sixth embodiments according to the present invention have each a sliding frame 9 put on the front ends of a jib 2 for sliding motion along the jib 2. The extremity of the piston rod 81 of a jib derricking cylinder actuator 8 is connected to the sliding frame 9. In the fifth embodiment, the jib derricking cylinder actuator 8 is disposed behind the sliding frame 9 and is attached to the lower surface of the jib 2. In the sixth embodiment, the jib derricking cylinder actuator 8 is attached to the upper surface of the jib 2. The sliding frame 9 is provided with sliding pads, not shown, on the inner surfaces thereof to enable the sliding frame 9 to slide smoothly along the jib 2. The sliding pads may be substituted by rollers provided on the inner surfaces of the sliding frame 9 in rolling contact with the outer surfaces of the jib 2.

The jib derricking cylinder actuator 8 functions as a compression member and hence the jib derricking cylinder actuator 8 may be having a cylinder having a comparatively small diameter.

Although the jib derricking cylinder actuator 8 is mounted on the jib 2 so that the piston rod 81 thereof functions as the movable actuating member in the second to sixth embodiments, the jib derricking cylinder actuator 8 may be mounted on the jib 2 with the cylinder 82 disposed near the front end of the jib 2 so that the cylinder 82 thereof functions as the movable actuating member.

Although the jib derricking gears in the second to sixth embodiments each employ the single jib derricking cylinder actuator 8 and the front ends of the suspension rods 7 are connected to the jib derricking cylinder actuator 8, the jib derricking gears may be each provided with a pair of jib derricking cylinders attached to the upper or lower surface of the jib 2 in parallel to each other for synchronous operation, and the front ends of the suspension rods 7 may be connected to the jib derricking cylinder actuators, respectively. The pair of jib derricking cylinder actuators may be provided on the opposite side walls of the jib, respectively.

Figure 15:
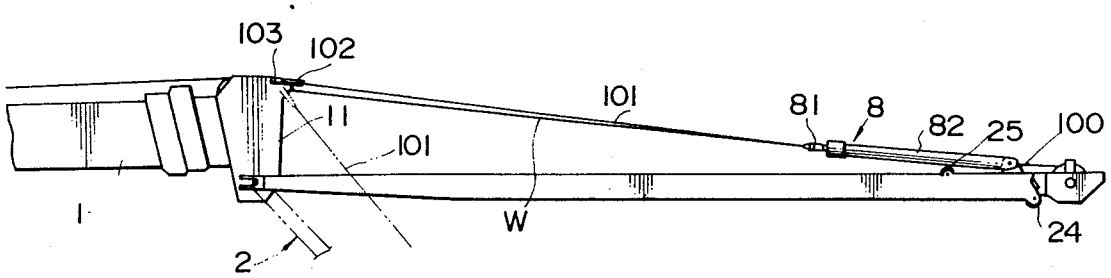
FIG. 15 is a side elevation of a jib, in a stretched position, provided with a jib derricking gear in a seventh embodiment according to the present invention.
Figure 16:
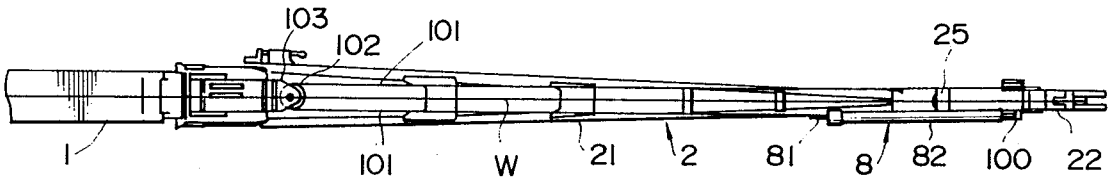
FIG. 16 is a plan view of the jib of FIG. 15.
Figure 17:
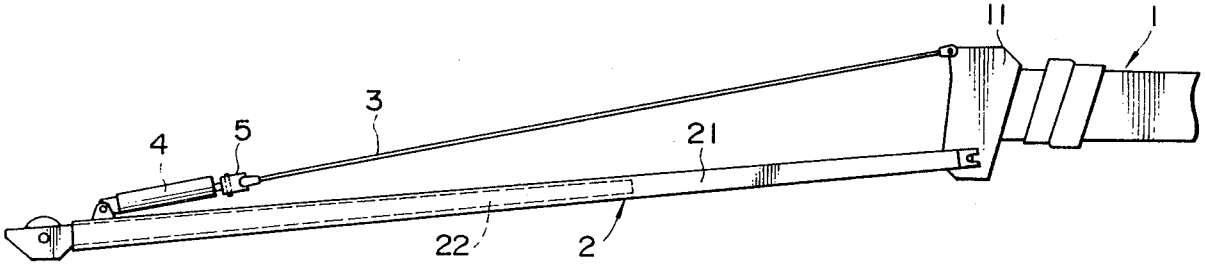
FIG. 17 PRIOR ART
FIG. 17 is a side elevation of a jib, in a stretched position, provided with a conventional jib derricking gear.
Figure 18:
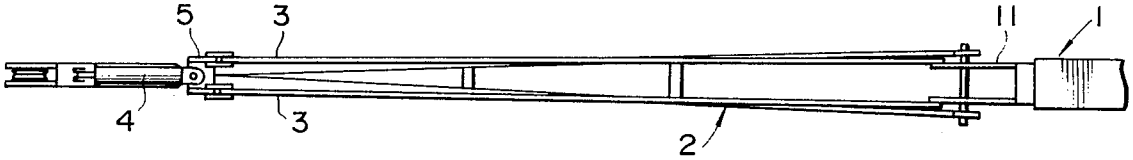
FIG. 18 PRIOR ART
FIG. 18 is a plan view of the jib of FIG. 17.

Seventh Embodiment (FIGS. 15 and 16)

A jib derricking gear in a seventh embodiment according to the present invention employs a single jib derricking cylinder actuator 8. The jib derricking cylinder actuator 8 is provided on the upper surface of the front end of a jib 2 and is set aside, in this embodiment, to the right as viewed in FIG. 16, with respect to the center axis of the jib 2. The base end of the cylinder 82 of the jib derricking cylinder actuator 8 is connected to a bracket 100 fixed to the extremity of the jib 2.

One end of a jib guy rope 101 is fastened to the extremity of the piston rod 81 of the jib derricking cylinder actuator 8. The jib guy rope 101 is extended around an equalizer sheave 102 rotatably supported on the boom head 11 of a boom 1 by a sheave support 103 attached to the boom head 11 so as to be swingable in the turning directions of the jib 2. The other end of the jib guy rope 101 is fastened to the upper surface of the front end of the jib 2 on the side, in this embodiment, the left side as viewed in FIG. 16, opposite the side where the jib derricking cylinder actuator 8 is disposed.

The piston rod 81 of the jib derricking cylinder actuator 8 is extended to turn the jib 2 downward and the piston rod 81 is retracted to turn the jib 2 upward.

When calculated simply neglecting friction, a force acting on the jib 2 to raise the same is double the thrust of the jib derricking cylinder actuator 8 on the principle of tackle. Accordingly, the jib derricking cylinder actuator 8 may be such as having a cylinder having a diameter far less than that of the cylinder of the jib derricking cylinder actuator 4 employed in the conventional jib derricking gear.

Since the jib derricking cylinder actuator 8 is set aside with respect to the center axis of the jib 2 and the jib guy rope 101 is extended on the opposite sides of the jib 2 with respect to the center axis, the jib derricking cylinder actuator 8 and the jib guy rope 101 do not interfere with a hoist rope W extended along the center axis of the jib 2. Accordingly, the jib derricking gear, similarly to those in the second, fourth and fifth embodiments, omits the guide members $G_1$ and $G_2$ for guiding the hoist rope W, which are essential to the conventional jib derricking gear, and hence has no problem in the abrasion of the hoist rope W. Furthermore, the jib derricking gear allows a large guide roller 25 to be provided as an upper guide for guiding the inner jib 22 of the jib 2.

What is claimed is:

1. A jib derricking gear for a crane, comprising:

a jib derricking cylinder actuator provided on a jib extending from a boom head of a boom, said jib derricking cylinder actuator having a movable actuating member thereof on the front side of the jib; and suspension rods each having a front end pivotally connected to the movable actuating member of the jib derricking cylinder actuator, and a rear end pivotally joined to the boom head.

2. A jib derricking gear according to claim 1, wherein the extremity of the movable actuating member of said jib derricking cylinder actuator is provided with a guide member, and a further guide member having a slot for longitudinally guiding the guide member is provided on the jib.

3. A jib derricking gear according to claim 2, wherein said guide member is a connecting pin pivotally connecting the extremity of the movable actuating member of said jib derricking cylinder actuator and the front end of said suspension rod.

4. A jib derricking gear according to claim 1, wherein said jib derricking cylinder actuator is provided on the lower surface of the jib, the extremity of the movable actuating member of said jib derricking cylinder actuator and the front end of said suspension rod are connected with a horizontal connecting pin, and guide rollers are mounted on the connecting pin so as to roll along the lower surface of the jib when the movable actuating member of said jib derricking cylinder actuator is moved.

5. A jib derricking gear for a crane, comprising:

a sliding member being longitudinally slidably positioned on he front end of a jib extended from a boom head of a boom;

a jib derricking cylinder actuator disposed near the front end of the jib and having a movable actuating member thereof on the front side of the jib, and with the extremity of the movable actuating member connected to the sliding member; and a suspension rod extended between the sliding member and the boom head of the boom.

6. A jib derricking gear according to any one of claims 1, 2, 3 and 5 wherein said jib derricking cylinder actuator is provided on the lower surface of the jib.

7. A jib derricking gear according to any one of claims 1, 2, 3 and 5, wherein said jib derricking cylinder actuator is provided on the upper surface of the jib.

8. A jib derricking gear according to any one of claims 1, 2, 3 and 4, wherein the front ends of the pair of suspension rods are connected to the movable actuating member of said jib derricking cylinder actuator.

9. A jib derricking gear according to any one of claims 1, 2, 3 and 4, wherein the front ends of the pair of suspension rods are connected to the movable actuating members of the pair of jib derricking cylinder actuators, respectively.

10. A jib derricking gear for a crane, comprising:

a jib derricking cylinder actuator provided on the front end of a jib extended from a boom head of a boom;

an equalizer sheave rotatably supported on the boom head by a supporting member capable of swinging in turning directions of the jib; and a jib guy roper extended around the equalizer sheave and having one end connected to the jib derricking cylinder actuator and the other end fastened to the front end of the jib;

wherein said jib derricking cylinder actuator is set aside to one side of the front end of the jib with respect to the center axis of the jib, and the other end of the jib guy rope is fastened to the front end of the jib at a position opposite the jib derricking cylinder actuator with respect to the center axis of the jib.

* * * * *